US010683700B2

(12) United States Patent
Wang

(10) Patent No.: US 10,683,700 B2
(45) Date of Patent: Jun. 16, 2020

(54) EASY-OPEN SAFETY GATE FOR A BARRIER

(71) Applicant: DEMBY DEVELOPMENT CO., LTD., New Taipei (TW)

(72) Inventor: Tsung-Hsiang Wang, New Taipei (TW)

(73) Assignee: DEMBY DEVELOPMENT CO., LTD., New Taipei (TW)

( * ) Notice: Subject to any disclaimer, the term of this patent is extended or adjusted under 35 U.S.C. 154(b) by 193 days.

(21) Appl. No.: 15/985,758

(22) Filed: May 22, 2018

(65) Prior Publication Data

US 2019/0360263 A1 Nov. 28, 2019

(51) Int. Cl.

| | |
|---|---|
| ***E06B 3/68*** | (2006.01) |
| ***E06B 9/04*** | (2006.01) |
| ***E06B 9/06*** | (2006.01) |
| ***E05B 65/00*** | (2006.01) |
| ***E06B 11/02*** | (2006.01) |
| *E06B 9/00* | (2006.01) |

(52) U.S. Cl.

CPC ..... *E06B 9/04* (2013.01); *E05B 65/0007* (2013.01); *E05B 65/0014* (2013.01); *E06B 9/0623* (2013.01); *E06B 11/02* (2013.01); *E06B 2009/002* (2013.01)

(58) Field of Classification Search

CPC ..... E06B 9/0623; E06B 11/02; E06B 9/063; E06B 9/04; E06B 2009/002; E06B 9/002; E06B 9/02; E05C 3/00; E05C 5/02; B62D 33/037

USPC ..... 49/55, 57, 463, 465, 226, 50

See application file for complete search history.

(56) References Cited

U.S. PATENT DOCUMENTS

| | | | | |
|---|---|---|---|---|
| 6,027,104 | A | 2/2000 | Alexander et al. | |
| 6,112,461 | A * | 9/2000 | Cheng | E06B 9/04 292/DIG. 12 |
| 6,446,395 | B2 * | 9/2002 | Rogers | E06B 9/04 160/215 |
| 7,152,372 | B2 * | 12/2006 | Cheng | E05B 65/0014 49/465 |
| 7,334,624 | B2 * | 2/2008 | Waldman | E05B 17/2053 160/144 |
| 7,540,046 | B1 * | 6/2009 | Lai | A47D 13/065 256/26 |

(Continued)

*Primary Examiner* — Chi Q Nguyen

(74) *Attorney, Agent, or Firm* — Alan D. Kamrath; Karin L. Williams; Mayer & Williams PC

(57) ABSTRACT

An easy-open safety gate for a barrier has a first door panel, a second door panel, a positioning assembly, and a locking assembly. The positioning assembly has a positioning base securely attached to a lower end portion of the first door panel, and an engaging member securely attached to a lower transversely bar of the second door panel and detachably engages with the positioning base. The locking assembly has a resilient locking member mounted in an upper end portion of the first door panel, and a locking housing pivotally mounted on an upper transverse bar of the second door panel and detachably engaging with the resilient locking member. No threshold is disposed below the safety gate. A user can unlock the locking assembly and rotate the second door panel with only one of his/her hands, which is convenient and safe for the user to open the safety gate.

9 Claims, 10 Drawing Sheets

(56) References Cited

U.S. PATENT DOCUMENTS

| | | | | |
|---|---|---|---|---|
| 7,874,103 | B2 * | 1/2011 | Yates | E06B 9/04 49/226 |
| 7,963,575 | B2 * | 6/2011 | Mayo | E05B 65/0007 160/225 |
| D714,960 | S | 10/2014 | Weisbeck | |
| 9,091,113 | B2 * | 7/2015 | Pilgrim | E06B 9/06 |
| 9,279,284 | B1 * | 3/2016 | Axelrod | E06B 11/02 |
| 9,388,603 | B2 * | 7/2016 | Flannery | E05B 1/0053 |
| 2004/0045222 | A1 * | 3/2004 | Hicks | E05F 1/066 49/394 |
| 2007/0074453 | A1 * | 4/2007 | Flannery | E06B 7/32 49/57 |
| 2012/0324792 | A1 * | 12/2012 | Bertsch | E06B 9/04 49/37 |

* cited by examiner

EASY-OPEN SAFETY GATE FOR A BARRIER

BACKGROUND OF THE INVENTION

1. Field of the Invention

The present invention relates to a safety gate for a barrier, especially to a safety gate that can be easily opened.

2. Description of the Prior Art(s)

Barriers can be placed across passageways to block access to a specific area or around children or pets to restrict their movements to a given area to keep them from being harmed.

The barrier has two or more barrier segments, a gate, and multiple barrier hinge assemblies. The barrier segments and the gate are arranged in series, circularly or linearly, and are pivotally connected with each other via the barrier hinge assemblies. The gate can be opened to allow the children or the pets and their parents or owners to pass therethrough, or the gate can be closed to enclose the children or the pets in the barrier.

Conventional barriers may or may not have a threshold disposed below the gate. The threshold is connected to two of the barrier hinges assemblies with two opposite ends of the threshold and allows the conventional barrier to remain structurally stable when the gate is opened. A conventional barrier without threshold becomes structurally unstable when the gate is opened. However, while passing through the gate that has the threshold disposed below the gate, the user, the children, and the pets might stumble over the threshold, which is very dangerous.

Moreover, out of safety concerns, the gate is securely locked while being closed. However, it is inconvenient if a user has to open the gate with both hands, especially when the user holds a child or a pet in his/her arms.

To overcome the shortcomings, the present invention provides an easy-open safety gate for a barrier to mitigate or obviate the aforementioned problems.

SUMMARY OF THE INVENTION

The main objective of the present invention is to provide an easy-open safety gate for a barrier. The barrier can remain structurally stable when the gate is opened, and a user can open the safety gate with only one hand while the user holds a child or a pet in his/her arms. The easy-open safety gate for the barrier has a first door panel, a second door panel, a positioning assembly, and a locking assembly.

The first door panel has an upper end portion and a lower end portion. The upper end portion is tubular and has a through hole defined through a sidewall of the upper end portion. The second door panel has an upper transverse bar and a lower transverse bar. The upper transverse bar has a mounting end. The lower transverse bar has a positioning end.

The positioning assembly includes a positioning base and an engaging member. The positioning base is securely attached to the lower end portion of the first door panel. The engaging member is securely attached to the positioning end of the lower transversely bar and is selectively mounted in and detachably engages with the positioning base.

The locking assembly includes a resilient locking member and a locking housing. The resilient locking member is mounted in the upper end portion of the first door panel and has a locking protrusion resiliently mounted through the through hole of the upper end portion. The locking housing is pivotally mounted on the mounting end of the upper transverse bar, selectively covers the upper end portion of the first door panel, and detachably engages with the locking protrusion of the resilient locking member when the locking housing covers the upper end portion of the first door panel.

A user can unlock the locking assembly and rotate the second door panel with only one of his/her hands. Therefore, it is convenient and safe for the user to open the safety gate when the user holds a child or a pet in his/her arms. Moreover, since the first door panel stands still when the second door panel is opened, the barrier with the safety gate can remain structurally stable when the second door panel is opened. No threshold is needed to be disposed below the first door panel and the second door panel. Accordingly, the user, the children, and the pets do not stumble over the threshold while passing through the safety-gate.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
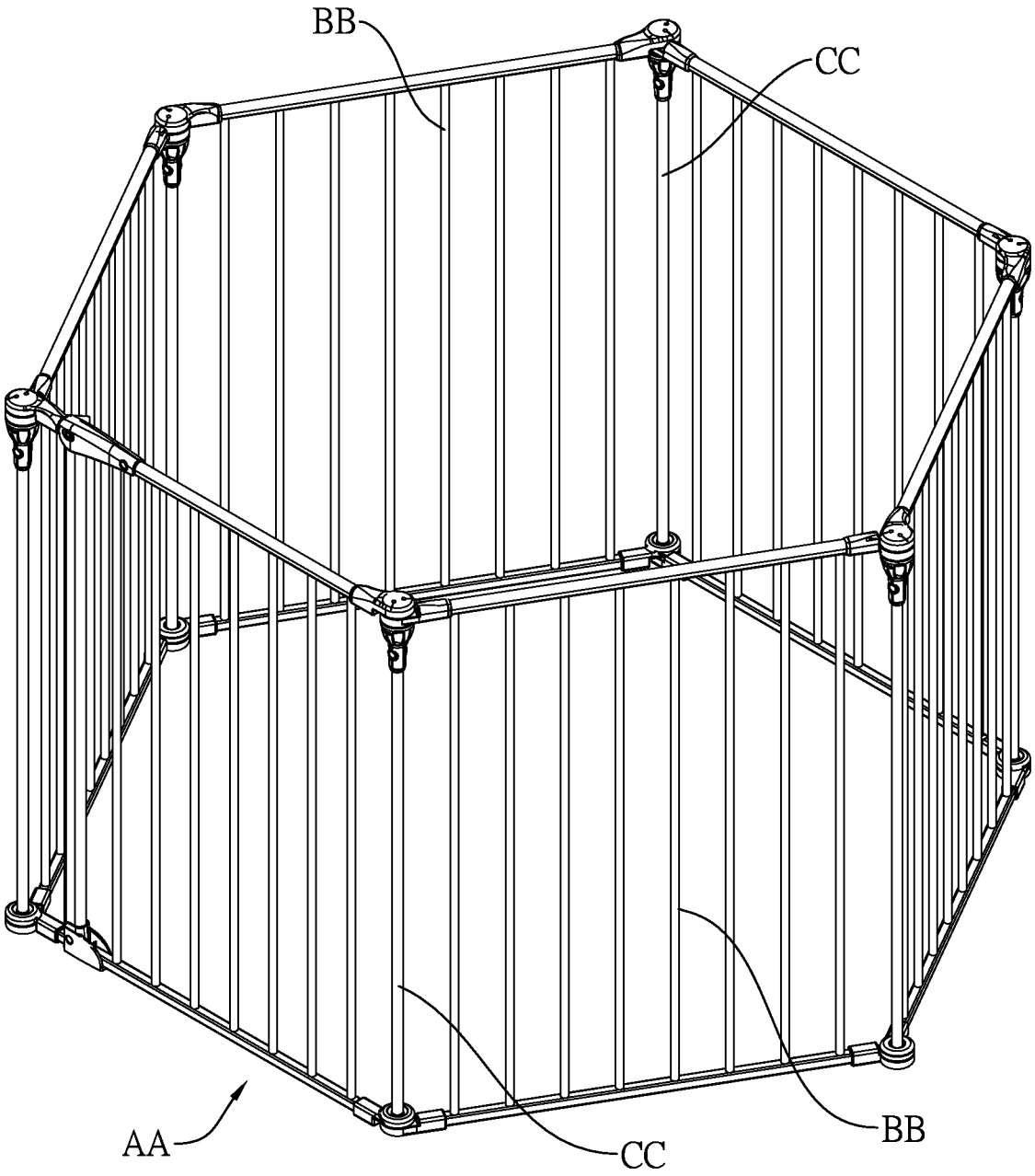
FIG. 1 is a perspective view of a barrier with an easy-open safety gate in accordance with the present invention.
Figure 2:
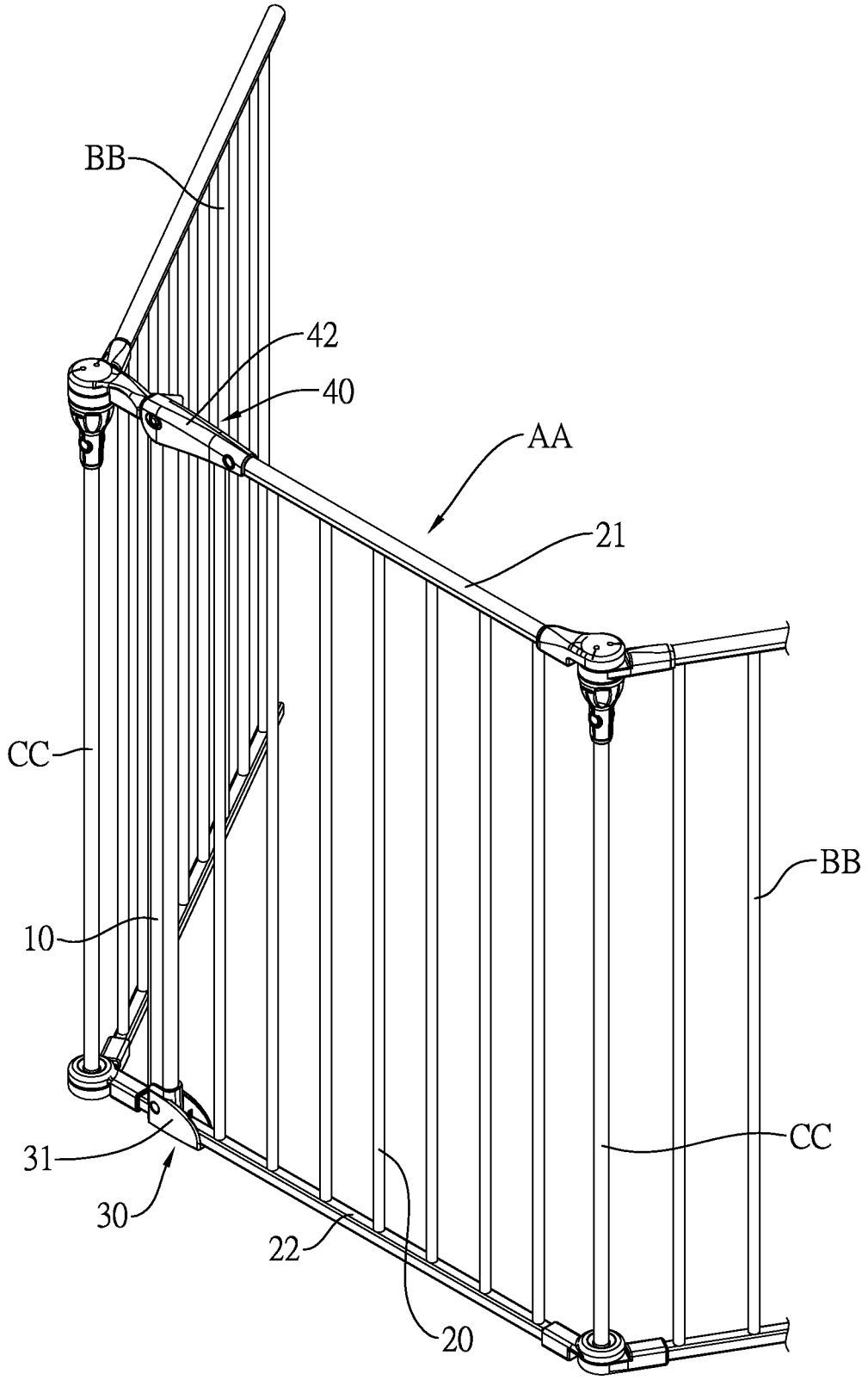
FIG. 2 is an enlarged partially perspective view of the barrier with the easy-open safety gate in FIG. 1.

With reference to FIG. 1, a barrier includes two or more barrier segments BB and a safety gate AA in accordance with the present invention. The barrier segments BB and the safety gate AA are arranged in series, circularly or linearly. Each two of the safety gate AA and the barrier segments BB that are disposed next to each other are pivotally connected with each other via a barrier hinge assembly CC. With further reference to FIG. 2, the safety gate AA comprises a first door panel 10, a second door panel 20, a positioning assembly 30, and a locking assembly 40.

Figure 3:
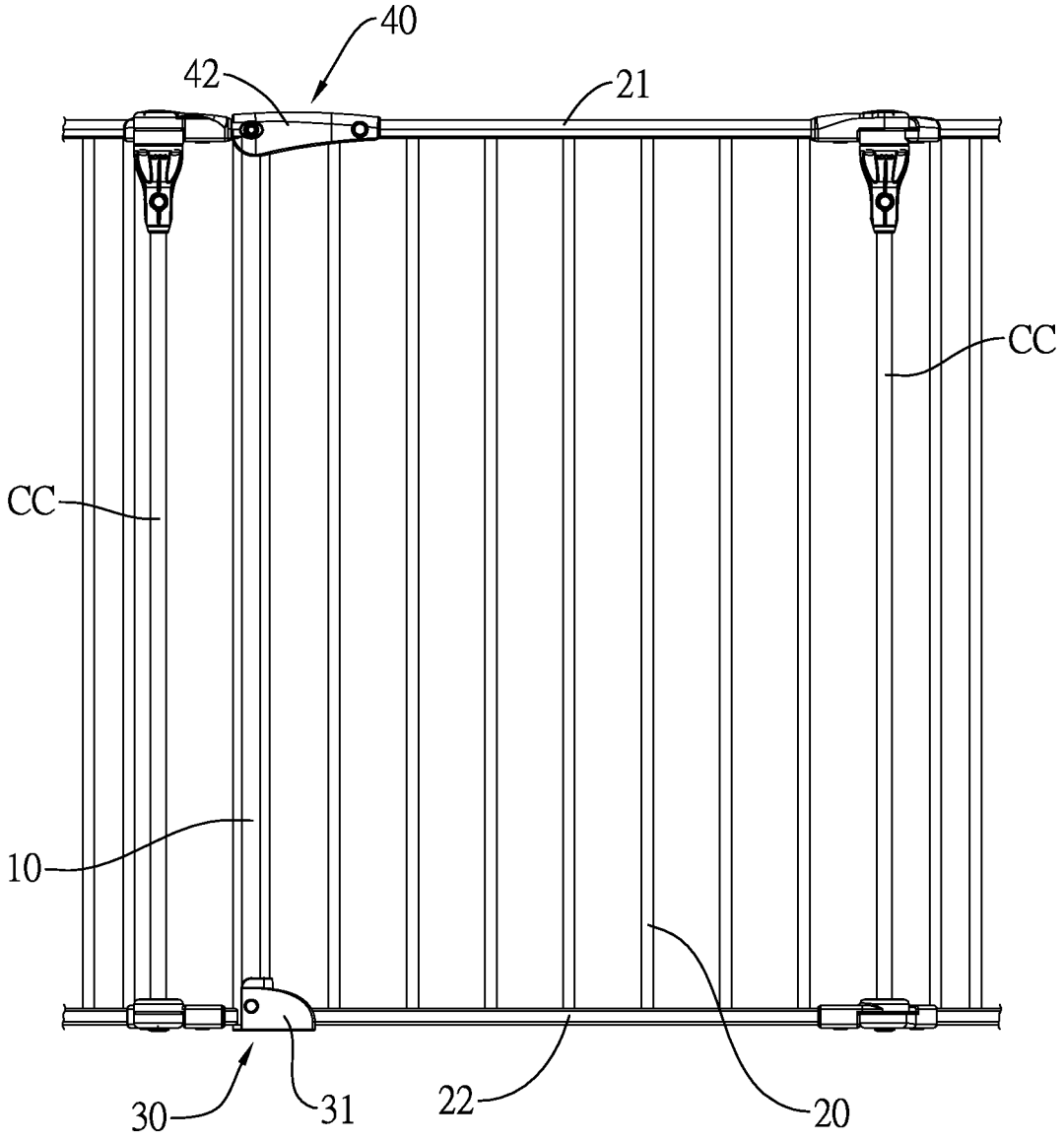
FIG. 3 is a partially front view of the barrier with the easy-open safety gate in FIG. 1, wherein the safety gate is shown closed.
Figure 4:
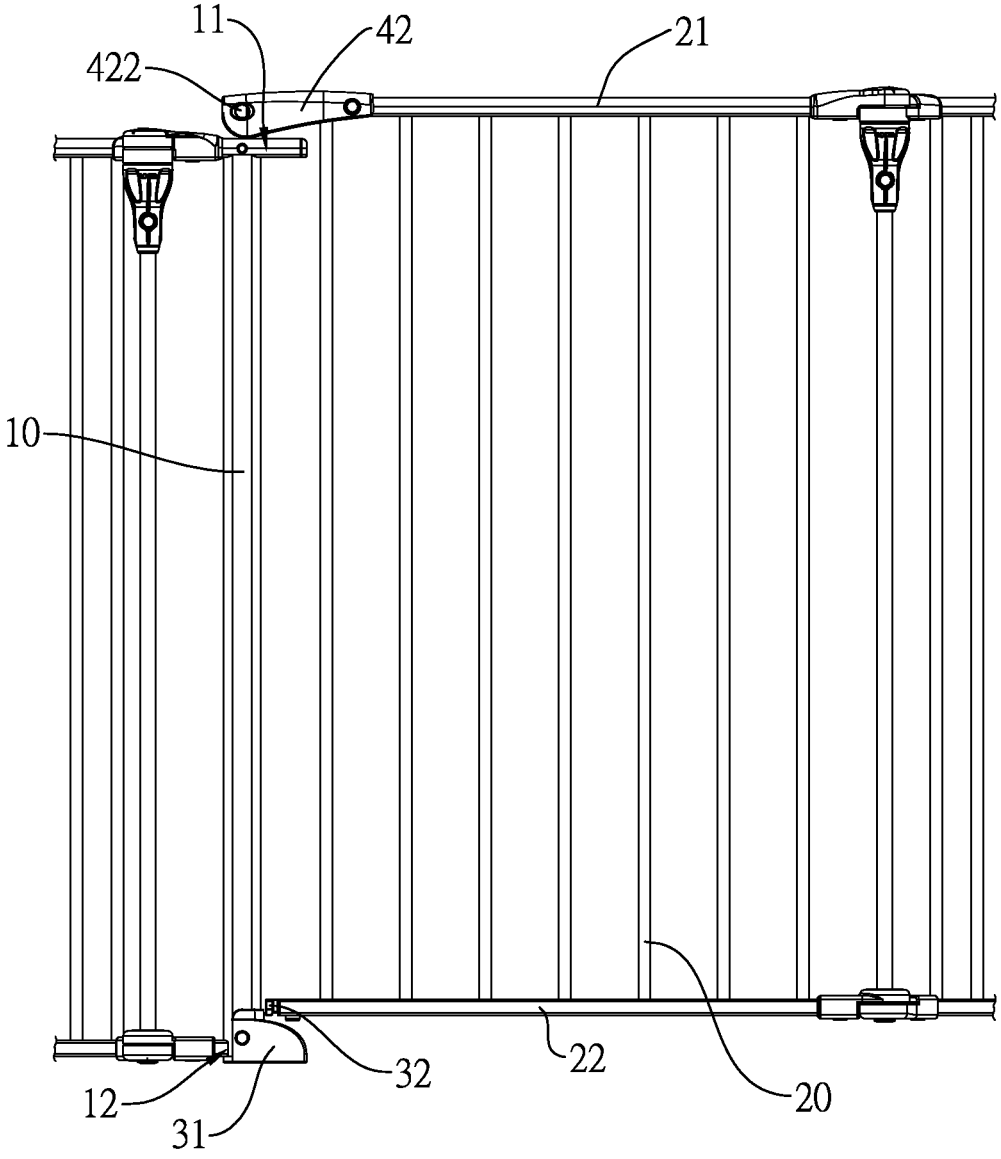
FIG. 4 is a partially front view of the barrier with the easy-open safety gate in FIG. 1, wherein the safety gate is shown opened.
Figure 5:
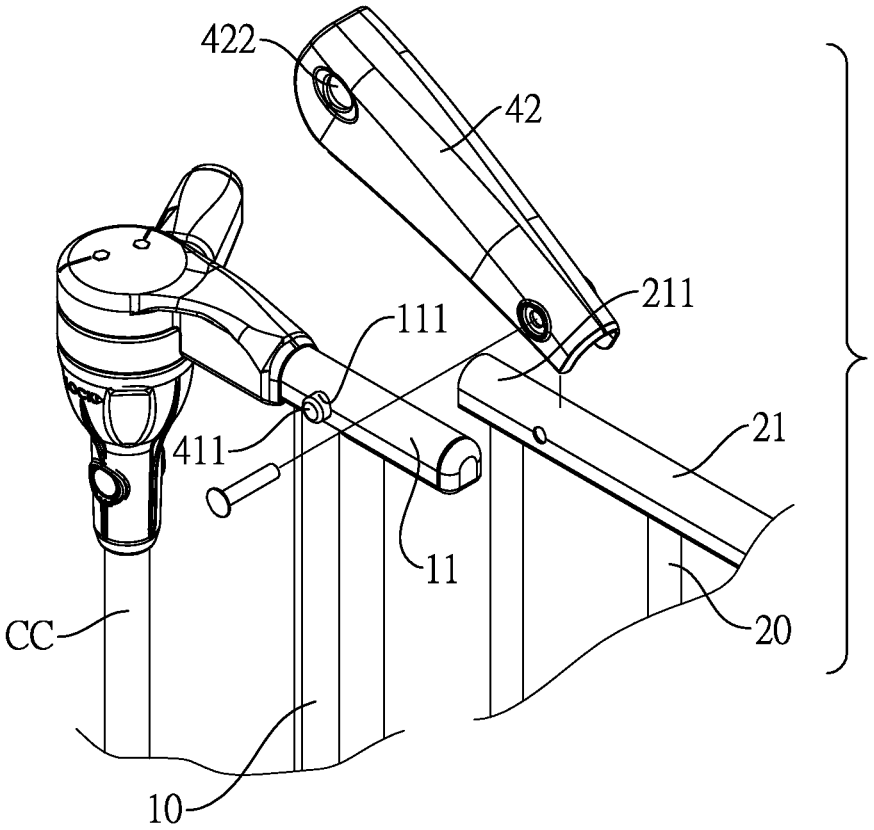
FIG. 5 is an enlarged exploded perspective view of the barrier with the easy-open safety gate in FIG. 1.
Figure 6:
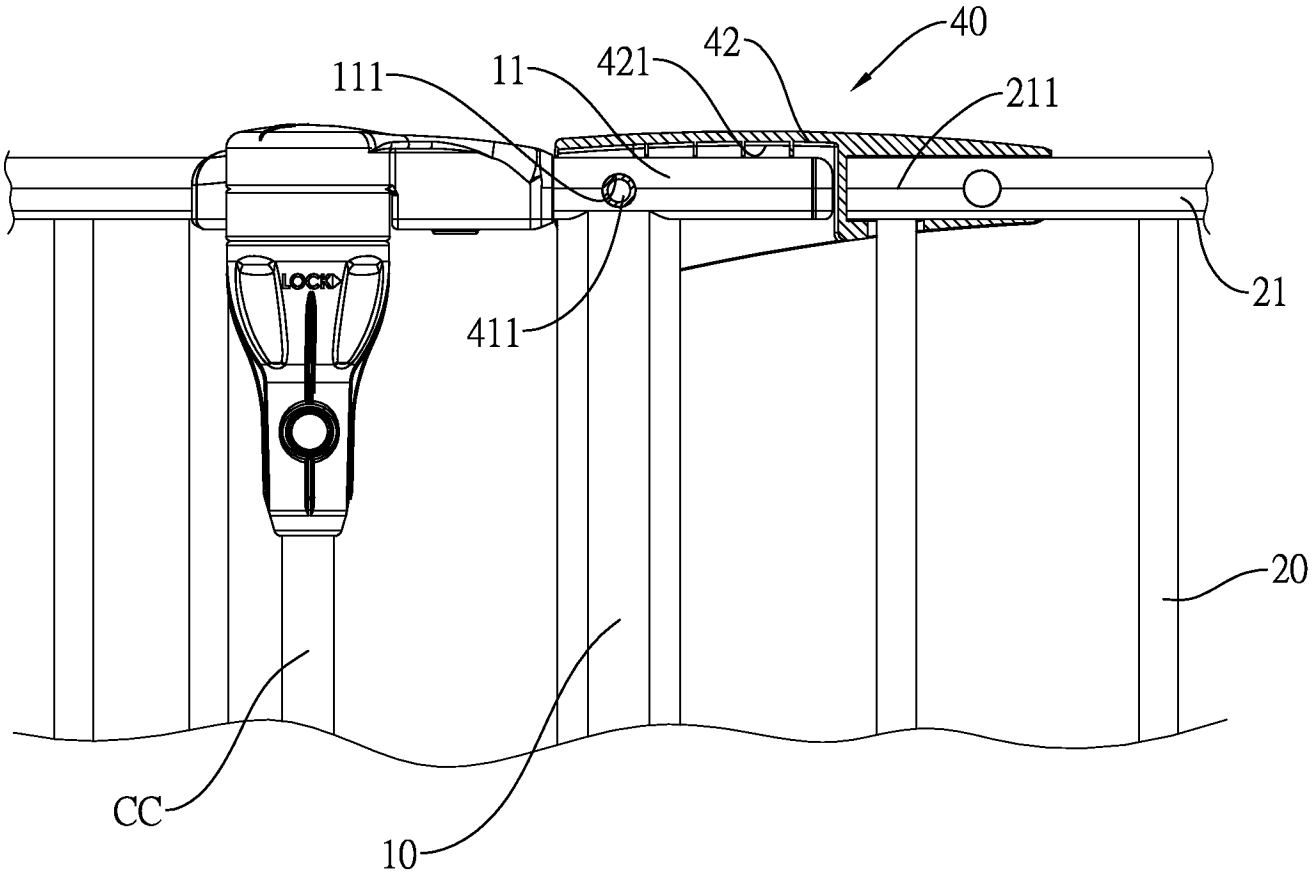
FIG. 6 is an enlarged front view in partial section of the barrier with the easy-open safety gate in FIG. 1.

With reference to FIGS. 2 to 4, the first door panel 10 is pivotally connected to a corresponding one of the barrier segments BB via one barrier hinge assembly CC and has an upper end portion 11 and a lower end portion 12. With further reference to FIGS. 5 and 6, the upper end portion 11 is tubular and has a through hole 111 defined through a sidewall of the upper end portion 11.

Figure 9:
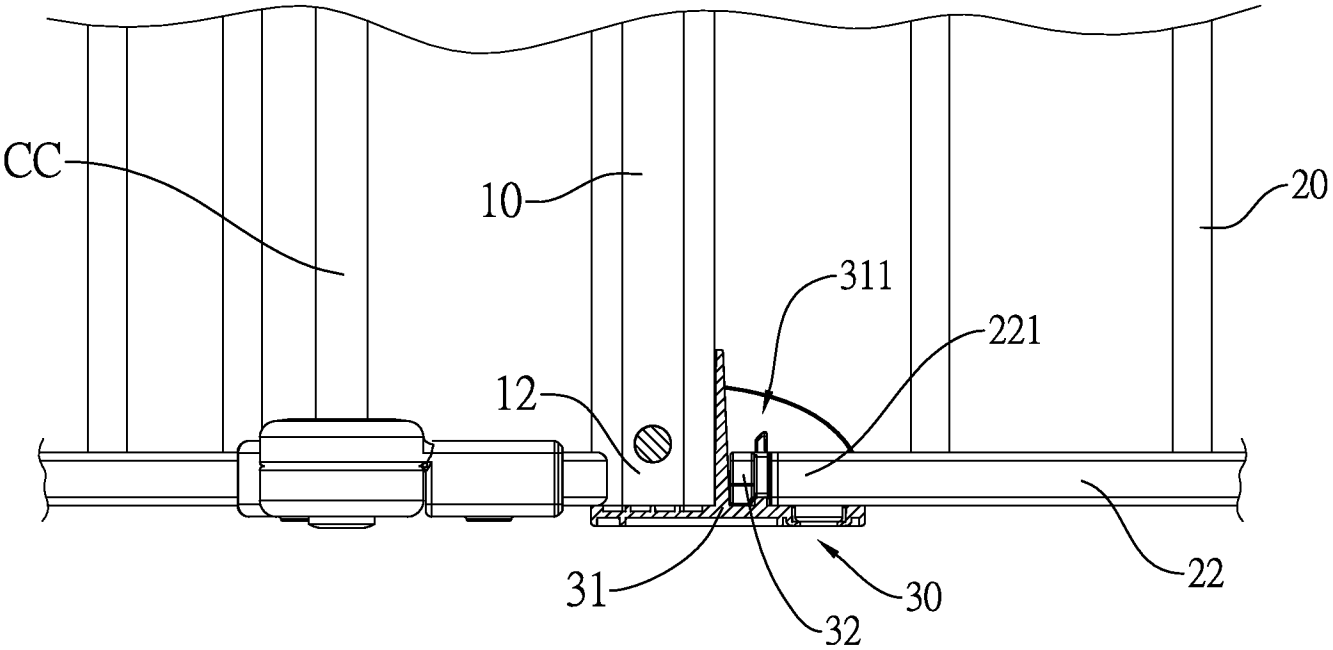
FIG. 9 is another enlarged front view in partial section of the barrier with the easy-open safety gate in FIG. 1.

With further reference to FIGS. 2, 6, and 9, the second door panel 20 is pivotally connected to a corresponding one of the barrier segments BB via one barrier hinge assembly CC and has an upper transverse bar 21 and a lower transverse bar 22. As shown in FIG. 6, the upper transverse bar 21 has a mounting end 211 protruding toward the upper end portion 11 of the first door panel 10. As shown in FIG. 9, the lower transverse bar 22 has a positioning end 221 protruding toward the lower end portion 12 of the first door panel 10.

Figure 8:
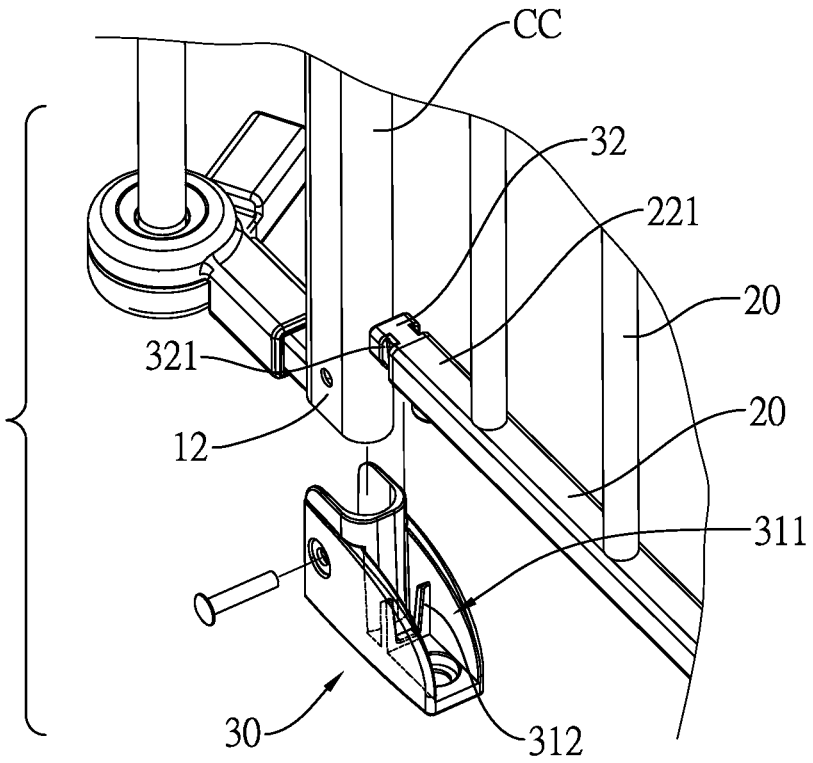
FIG. 8 is another enlarged exploded perspective view of the barrier with the easy-open safety gate in FIG. 1.
Figure 10:
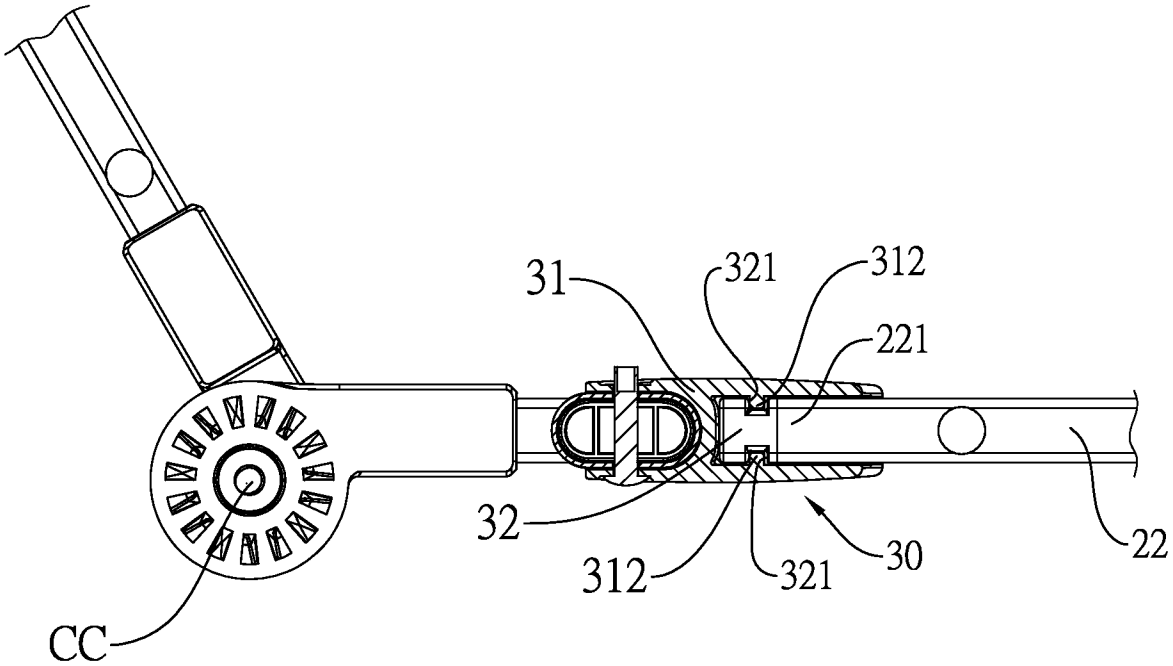
FIG. 10 is another enlarged top view in partial section of the barrier with the easy-open safety gate in FIG. 1.

With further reference to FIGS. 8 to 10, the positioning assembly 30 is mounted on the lower end portion 12 of the first door panel 10 and the positioning end of the lower transverse bar 22 of the second door panel 20, and includes a positioning base 31 and an engaging member 32.

The positioning base 31 is securely attached to the lower end portion 12 of the first door panel 10 and protrudes toward the lower transverse bar 22.

In the preferred embodiment, the positioning base 31 has a mounting recess 311, two inner sidewalls, and at least one engaging protrusion 312. The mounting recess 311 is formed in the positioning base 31 and defines an opening on the positioning base 31. The opening of the positioning base 31 faces the upper end portion 11 of the first door panel 10 and the lower transverse bar 22 of the second door panel 20, as shown in FIG. 2. The inner sidewalls of the positioning base 31 are oppositely defined in the mounting recess 311. The at least one engaging protrusion 312 is formed on and protrudes from at least one of the inner sidewalls of the positioning base 31.

The engaging member 32 is securely attached to the positioning end 221 of the lower transversely bar 22, transversely protrudes toward the lower end portion 12 of the first door panel 10, and is selectively mounted in and detachably engages with the positioning base 31.

In the preferred embodiment, the engaging member 32 is formed as a block and has two opposite side surfaces and at least one engaging recess 321. The at least one engaging recess 321 is formed in at least one of the side surfaces of the engaging member 32 and engages with the at least one engaging protrusion 312 when the engaging member 32 is mounted in the mounting recess 311 of the positioning base 31.

Specifically, the at least one engaging protrusion 312 of the positioning base 31 includes two engaging protrusions 312. The two engaging protrusions 312 are formed on and protrude from the two inner sidewalls of the positioning base 31, respectively. The at least one engaging recess 321 of the engaging member 32 includes two engaging recesses 321. The two engaging recesses 321 are formed in the two opposite side surfaces of the engaging member 32 respectively.

Figure 7:
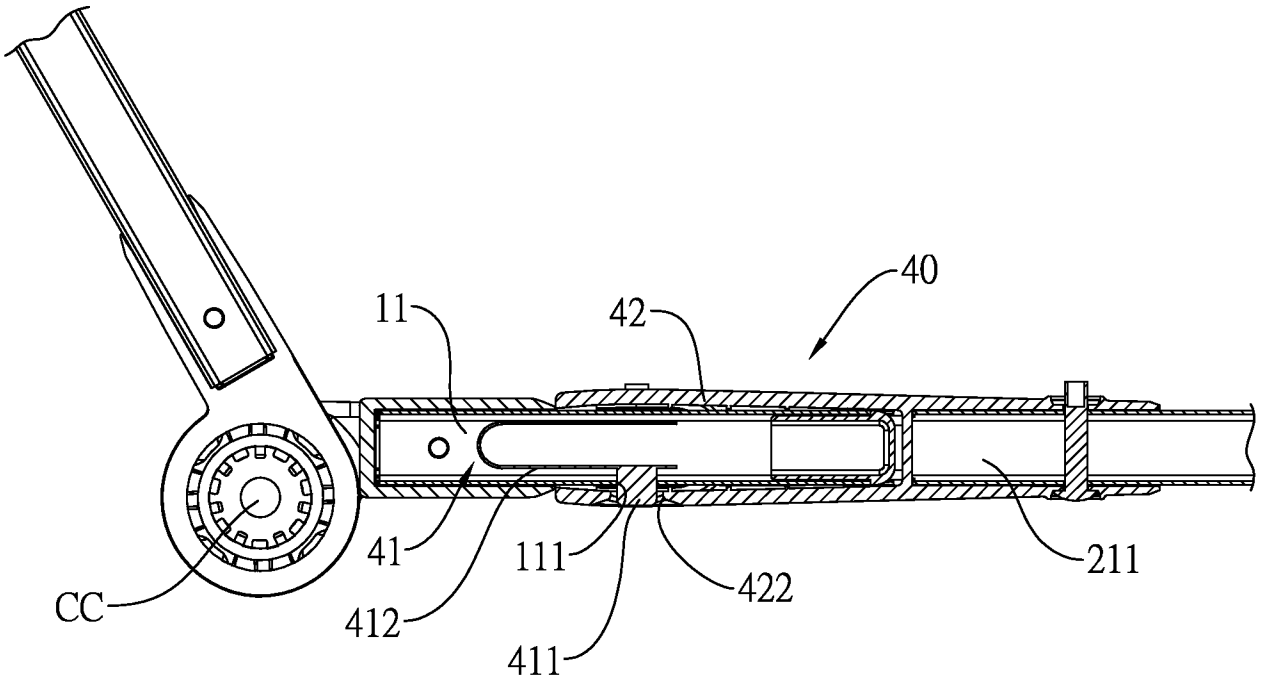
FIG. 7 is an enlarged top view in partial section of the barrier with the easy-open safety gate in FIG. 1.

With further reference to FIGS. 5 to 7, the locking assembly 40 is mounted on the upper end portion 11 of the first door panel 10 and the mounting end 211 of the upper transverse bar 21 of the second door panel 20, and includes a resilient locking member 41 and a locking housing 42.

As shown in FIGS. 5 and 7, the resilient locking member 41 is mounted in the upper end portion 11 of the first door panel 10 and has a locking protrusion 411. The locking protrusion 411 is resiliently mounted through the through hole 111 of the upper end portion 11.

In the preferred embodiment, the resilient locking member 41 has a resilient piece 412. The resilient piece 412 is bent to become V-shaped and has two abutting ends. The abutting ends of the resilient piece 412 abut on the sidewall of the upper end portion 11. The locking protrusion 411 is formed on and protrudes from one of the abutting ends of the resilient piece 412, such that the locking protrusion 411 is resiliently mounted through the through hole 111 of the upper end portion 11.

With reference to FIGS. 5 and 6, the locking housing 42 is pivotally mounted on the mounting end 211 of the upper transverse bar 21, selectively covers the upper end portion 11 of the first door panel 10, and detachably engages with the locking protrusion 411 of the resilient locking member 41 when the locking housing 42 covers the upper end portion 11 of the first door panel 10.

With reference to FIGS. 5 to 7, in the preferred embodiment, the locking housing 42 has a receiving recess 421 and a locking hole 422. The receiving recess 421 is formed in the locking housing 42 and defines an opening on the locking housing 42. The opening of the locking housing 42 faces the positioning end 221 of the lower transverse bar 22 and the upper end portion 11 of the first door panel 10. The locking hole 422 is formed through a sidewall of the locking housing 42. When the locking housing 42 covers the upper end portion 11 of the first door panel 10, the upper end portion 11 of the first door panel 10 is received in the receiving recess 421 of the locking housing 42 and the locking protrusion 411 of the resilient locking member 41 further protrudes through the locking hole 422 of the locking housing 42. Accordingly, the locking housing 42 can be securely mounted on the upper end portion 11 of the first door panel 10.

With reference to FIGS. 3, 6, 7, 9, and 10, when the second door panel 20 is closed relative to the first door panel 10, the engaging member 32 on the positioning end 221 of the lower transverse bar 22 of the second door panel 20 is mounted in the mounting recess 311 of the positioning base 31 and engages with the positioning base 31, and the locking housing 42 on the mounting end 211 of the upper transverse bar 21 of the second door panel 20 covers the upper end portion 11 of the first door panel 10 with the locking protrusion 411 of the resilient locking member 41 engaging in the locking hole 422 of the locking housing 42.

With reference to FIGS. 4 and 7, when opening the second door panel 20, a user holds the locking housing 42 and the mounting end 211 of the upper transverse bar 21 with one of his/her hands and presses the locking protrusion 411 of the resilient locking member 41 to allow the locking protrusion 411 to disengage from the locking hole 422 of the locking housing 42. Then the user lifts up the second door panel 20, so the locking housing 42 departs from the upper end portion 11 of the first door panel 10 and the engaging member 32 disengages from the positioning base 31 on the lower end portion 12 of the first door panel 10. Thus, the user can further rotate the second door panel 20 so as to open the second door panel 20.

With reference to FIGS. 2 to 4, the easy-open safety gate AA for the barrier BB as described has the following advantages. Since the user can unlock the locking assembly 40 and rotate the second door panel 20 with only one of his/her hands, it is convenient and safe for the user to open the safety gate AA when the user holds a child or a pet in his/her arms. Moreover, since the first door panel stands still when the second door panel is opened, the barrier with the safety gate can remain structurally stable when the second door panel is opened. No threshold is needed to be disposed below the first door panel 10 and the second door panel 20. Accordingly, the user, the children, and the pets do not stumble over the threshold while passing through the safety-gate AA.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A safety gate for a barrier comprising:

a first door panel having an upper end portion being tubular and having a through hole defined through a sidewall of the upper end portion; and a lower end portion;

a second door panel having an upper transverse bar, and the upper transverse bar having a mounting end protruding toward the upper end portion of the first door panel; and a lower transverse bar, and the lower transverse bar having a positioning end protruding toward the lower end portion of the first door panel;

a positioning assembly including a positioning base securely attached to the lower end portion of the first door panel and protruding toward the lower transverse bar; and an engaging member securely attached to the positioning end of the lower transversely bar, transversely protruding toward the lower end portion of the first door panel, and selectively mounted in and detachably engaging with the positioning base; and a locking assembly including a resilient locking member mounted in the upper end portion of the first door panel and having a locking protrusion resiliently mounted through the through hole of the upper end portion; and a locking housing pivotally mounted on the mounting end of the upper transverse bar, selectively covering the upper end portion of the first door panel, and detachably engaging with the locking protrusion of the resilient locking member when the locking housing covers the upper end portion of the first door panel.

2. The safety gate as claimed in claim 1, wherein the positioning base of the positioning assembly has a mounting recess formed in the positioning base and defining an opening on the positioning base, and the opening of the positioning base facing the upper end portion of the first door panel and the lower transverse bar of the second door panel;

two inner sidewalls oppositely defined in the mounting recess; and at least one engaging protrusion formed on and protruding from at least one of the inner sidewalls of the positioning base; and the engaging member of the positioning assembly has two opposite side surfaces; and at least one engaging recess formed in at least one of the side surfaces of the engaging member and engaging with the at least one engaging protrusion when the engaging member is mounted in the mounting recess of the positioning base.

3. The safety gate as claimed in claim 2, wherein the at least one engaging protrusion of the positioning base includes two engaging protrusions, and the two engaging protrusions are formed on and protrude from the two inner sidewalls of the positioning base, respectively; and the at least one engaging recess of the engaging member includes two engaging recesses, and the two engaging recesses are formed in the two opposite side surfaces of the engaging member respectively.

4. The safety gate as claimed in claim 2, wherein the resilient locking member has a resilient piece being bent to become V-shaped and having two abutting ends, and the abutting ends of the resilient piece abut on the sidewall of the upper end portion of the first door panel; and the locking protrusion of the resilient locking member is formed on and protrudes from one of the abutting ends of the resilient piece.

5. The safety gate as claimed in claim 4, wherein the locking housing has a receiving recess formed in the locking housing and defining an opening on the locking housing, and the opening of the locking housing facing the positioning end of the lower transverse bar and the upper end portion of the first door panel; and a locking hole formed through a sidewall of the locking housing;

thereby when the locking housing covers the upper end portion of the first door panel, the upper end portion of the first door panel is received in the receiving recess of the locking housing and the locking protrusion of the resilient locking member protrudes through the locking hole of the locking housing.

6. The safety gate as claimed in claim 2, wherein the locking housing has a receiving recess formed in the locking housing and defining an opening on the locking housing, and the opening of the locking housing facing the positioning end of the lower transverse bar and the upper end portion of the first door panel; and a locking hole formed through a sidewall of the locking housing;

thereby when the locking housing covers the upper end portion of the first door panel, the upper end portion of the first door panel is received in the receiving recess of the locking housing and the locking protrusion of the resilient locking member protrudes through the locking hole of the locking housing.

7. The safety gate as claimed in claim 1, wherein the resilient locking member has a resilient piece being bent to become V-shaped and having two abutting ends, and the abutting ends of the resilient piece abut on the sidewall of the upper end portion of the first door panel; and the locking protrusion of the resilient locking member is formed on and protrudes from one of the abutting ends of the resilient piece.

8. The safety gate as claimed in claim 7, wherein the locking housing has a receiving recess formed in the locking housing and defining an opening on the locking housing, and the opening of the locking housing facing the positioning end of the lower transverse bar and the upper end portion of the first door panel; and a locking hole formed through a sidewall of the locking housing;

thereby when the locking housing covers the upper end portion of the first door panel, the upper end portion of the first door panel is received in the receiving recess of the locking housing and the locking protrusion of the resilient locking member protrudes through the locking hole of the locking housing.

9. The safety gate as claimed in claim 1, wherein the locking housing has a receiving recess formed in the locking housing and defining an opening on the locking housing, and the opening of the locking housing facing the positioning end of the lower transverse bar and the upper end portion of the first door panel; and a locking hole formed through a sidewall of the locking housing;

thereby when the locking housing covers the upper end portion of the first door panel, the upper end portion of the first door panel is received in the receiving recess of the locking housing and the locking protrusion of the resilient locking member protrudes through the locking hole of the locking housing.

* * * * *